US005437213A

United States Patent [19]

Schulz

[11] Patent Number: 5,437,213

[45] Date of Patent: Aug. 1, 1995

[54] DEVICE FOR MANUFACTURING UNIFORM SHEETS FROM MATERIAL PANELS

[75] Inventor: Helmut Schulz, Schopfheim, Germany

[73] Assignee: Grapha-Holding AG, Hergiswil, Switzerland

[21] Appl. No.: 144,025

[22] Filed: Nov. 1, 1993

[30] Foreign Application Priority Data

Oct. 30, 1992 [CH] Switzerland ..... 03393/92

[51] Int. Cl.[6] ..... B65H 35/04; B26D 7/18; B26D 7/26

[52] U.S. Cl. ..... 83/98; 83/100; 83/152; 83/349; 83/674; 83/677; 83/698.51

[58] Field of Search ..... 83/663, 677, 674, 699, 83/349, 698.41, 698.51, 699.51, 698.61, 699.61, 116, 152, 98, 100

[56] References Cited

U.S. PATENT DOCUMENTS

| | | | |
|---|---|---|---|
| 1,515,377 | 11/1924 | White | 83/698.61 X |
| 2,081,363 | 5/1937 | Meisel | 83/349 |
| 2,582,522 | 1/1952 | Battersby | 83/698.61 X |
| 2,805,715 | 9/1957 | Novick | 83/349 X |
| 2,870,840 | 1/1959 | Kwitek | 83/349 X |
| 3,128,663 | 4/1964 | Dovey | 83/699 X |
| 3,214,106 | 10/1965 | Gorman | 83/698.41 X |
| 3,230,809 | 1/1966 | Liick | 83/699 X |
| 3,321,145 | 5/1967 | Gorman | 83/349 X |
| 4,187,753 | 2/1980 | Walde | 83/698.41 X |
| 4,467,687 | 8/1984 | Fokos et al. | 83/699 X |
| 4,911,047 | 3/1990 | Hornung et al. | 83/699 X |
| 5,140,880 | 8/1992 | Littleton | 83/98 |

FOREIGN PATENT DOCUMENTS

| | | | |
|---|---|---|---|
| 0486883 | 11/1991 | European Pat. Off. . | |
| 1101454 | 10/1955 | France | 83/349 |
| 1168773 | 12/1958 | France . | |
| 4023257A1 | 1/1992 | Germany . | |
| 276155 | 9/1951 | Switzerland . | |

*Primary Examiner*—Richard K. Seidel
*Assistant Examiner*—Clark F. Dexter
*Attorney, Agent, or Firm*—Spencer, Frank & Schneider

[57] ABSTRACT

A device for manufacturing uniform sheets from paper panels having a cutter roller which has, at its circumference, at least one pair of blades which interact with a stationary counter blade. Each blade is individually adjustable and is fastened to a mounting surface of a prismatic recess wherein the mounting surface extends parallel to the rotation axis of the cutter roller. Each blade is adjustable by way of a feeding member which acts perpendicularly on the blade for radial adjustment of the blade.

10 Claims, 1 Drawing Sheet

DEVICE FOR MANUFACTURING UNIFORM SHEETS FROM MATERIAL PANELS

CROSS REFERENCE TO RELATED APPLICATION

This application claims the priority of patent application Ser. No. CH 03393/92-4 filed Oct. 30, 1992 in Switzerland, the subject matter of which is incorporated herein by reference.

BACKGROUND OF THE INVENTION

The present invention relates to a device for manufacturing uniform sheets of material panels such as paper, textiles, or plastics by separating strip-shaped segments extending transversely of the direction of the material panel and comprising a rotating cutter roller which is driven in the cutting region in the same direction as the material panel and is provided at the circumference with at least one adjustable pair of blades which interacts with a counter blade.

Devices of the type mentioned above are used particularly in the manufacturing of printed material panels wherein strip-shaped segments between printed pictures are separated so that the desired format can be imparted to the sheet.

German Offenlegungsschrift (Unexamined Published Patent Application) 4,023,257 discloses a device referred to as a cutter roller, which is provided with two pairs of blades distributed over the circumference of the cutter roller and fastened parallel and adjacent to one another to a support formed by recesses.

To adjust these blades in relation to a stationary counter blade, these blades are spaced offset to project by a small measure beyond the cutting circle and are loosely secured by clamping so that during the manual rotation of the cutter roller the counter blade returns them to the cutting position where they can be screwed tight. This procedure often proves insufficient with respect to precision and requires a follow-up adjustment necessitated by unevennesses between the interacting blades.

In another prior art arrangement the blades are fixed to shafts which contact one another in an adjustable manner, and are fixed to a chord on the cutter roller. The precise adjustment of each blade is very time consuming, because their individually adjustable shafts contact one another, with a resulting static friction complicating the change and adjustment of a blade.

If a strip that is separated from a panel of material is held by a vacuum between the blades and is subsequently removed by air pressure, conduits that penetrate the shafts of both blades at a plurality of locations are required over the width of the cutter roller.

SUMMARY OF THE INVENTION

It is therefore an object of the present invention to provide a device, particularly a cutter roller, for producing uniform sheets from panels of material, making it possible to obtain in a simple manner high quality cuts and a long service life of the blades.

According to the invention, this object is attained by a roller cutter in which two blades are fastened to respective mounting surfaces formed by two adjacent prismatic recesses. The mounting surfaces jointly form an angle and are located on opposite sides of an approximately radial plane of the cutter roller, each blades being adjustable by means of a plurality of feeding members that act on the blades and are located behind the blade approximately perpendicularly in relation to the mounting surface.

It will thus be possible to provide the blades with a simple form and to match them precisely with the counter blade so that they may be readjusted.

In order to reduce the cutting moment over the width of the panel of material it may be necessary for the blades of the cutter roller to deviate slightly from axial parallelism with the latter; this is in view of the characteristic of the approximately radial plane.

The feeding members are advantageously configured as screws, each of which penetrates a bore extending from the circumference of the cutter roller to the opposite mounting surface, with the screws being advantageously provided with a fine-pitch thread on account of the small adjustment values, thereby making it possible to adjust and fasten the blades in a reliable manner.

In the case of screws as feeding members, the bores are advisably provided with corresponding threads whose arrangement in the bore corresponds to the type of the screw that is employed.

A favorable type of arrangement of the blades can be obtained if the mounting surfaces are arranged approximately at right angles to one another, which makes it also possible to realize a simple configuration of the blades.

In this case, the end of a shaft provided with the blade may have a step-like configuration, and the blade may be fastened both to the step set off toward the back and to the projecting end.

The blade could, of course, be configured in one piece with a shaft, for example, it could be made of a tool steel or in the form a cutting disc fastened to a constructional steel. All longitudinal edges of a shaft could be configured as re-sharpenable blades.

If the strip-shaped segments are held between the blades with the help of suction air and are subsequently discharged or ejected by blown air and atmospheric pressure, it is advantageous if the cutter roller at the circumference between the blades is configured by a narrow strip bordering on the intermediate space. This strip determines the position of the blades and the shafts of the blade may rest against it so that it serves the opening of connecting conduits which are alternately connected to a vacuum or a compressed air source.

In order to be able to cut segments of different width or to hold them in the intermediate space subsequent to cutting—this applies particularly to segments that are narrower than could be produced due to the distance between a pair of blades—it is advisable to extend the connecting conduits by means of an air-guiding strip that is fastened to the blade-positioning strip and whose segments forming one end of the respective connecting conduit open laterally offset into the intermediate space.

For this purpose the extension segments of the connecting conduit may be given a curve that is angled toward the side of the intermediate space.

Due to the difficulties arising from the manufacture of a bore extending transversely from the perpendicular to the surface of the workpiece, the connecting conduit may be widened directly upstream of the extension segment so that the deviation of the drill's angle of impact from the perpendicular to the workpiece may be limited.

BRIEF DESCRIPTION OF THE DRAWINGS

The invention is elucidated below by way of a drawings which illustrate an exemplary embodiment and in which.

DETAILED DESCRIPTION OF THE PREFERRED EMBODIMENT

Figure 1:
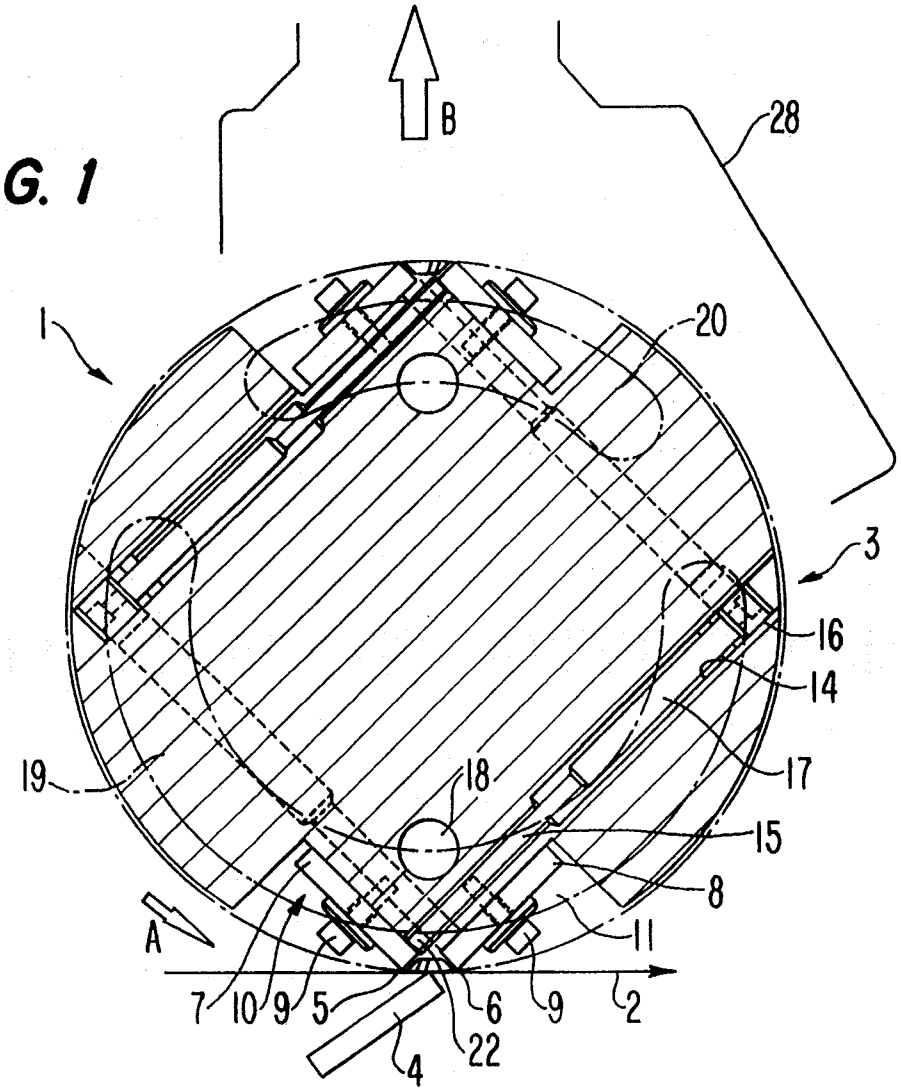
FIG. 1 is a cross sectional view of the device according to the invention.

FIG. 1 shows a device 1—a portion of a transverse cutter—for the manufacture of uniform individual sheets from panels of material 2 such as paper, textiles or plastics.

Especially in rotary offset printing, unprinted strips are created on the printed product between the printed pictures, due to the fastening devices for the printing plate and the rubber sheet on the printing cylinders. An example is a printing cylinder circumference or print size of 24" or 609.6 mm, which is used for producing two DIN (German Industrial Standards) A4 formats each having a length of 297 mm.

Due to their proportion of the width of the strip, the size of the printed sheets obtained from paper panels in a seamless succession, is decreased at their ends by one half of the width of the strip, and in the center by the entire cut-out unprinted width of the strip. This situation requires the use of a pair of blades at the circumference of the cutter roller. The speed of these blades is twice as fast at the cutting circle in relation to the printed paper panel and to a print cylinder circumference of 24", or a speed that is higher in proportion to the relationship between the cutting format and the circumference of the cutting circle. In the present case this means that 7.8 mm strips are removed from the paper panel.

In order to prevent imbalance of the cutter roller, the latter is advantageously provided with two pairs of blades which are located opposite one another on the circumference, and if only one pair of blades is used, the other pair of blades is set back behind the cutting circle.

The illustrated device 1 comprises a rotating cutter roller 3, which, in the cutting region is driven in the same direction as the material panel 2 (direction of rotation according to arrow A). At its circumference the cutter roller is provided with at least one adjustable pair of blades for interacting with a stationary counter blade. Each blade 7, 8 has two flanks jointed at an angle to form a cutting edge 5, 6. Stationary counter blade 4, like the blades of the cutter roller, may also deviate slightly with respect to its parallelism of the rotation axis—and interact with the pair of blades 7, 8. Each cutting edge extends over the cutting width of the device 1 and each blade 7, 8 is fastened by means of a plurality of screws 9 to a mounting surface 12, 13, which is configured by means of a prismatic recess 10, 11, respectively. The mounting surfaces 12, 13 form a right angle at cutter roller 3 with the angle being approximately evenly distributed on both sides of a radial plane of the rotation axis.

A feeding member formed by a plurality of screws 17 acts perpendicularly to mounting surface 12, 13 upon the end of blade 7, 8 closest to cutting edges 5, 6. This makes possible the precise adjustment of cutting edges 5, 6 with respect to the counter blade 4.

Due to the special relationships of configurations on the cutter roller, the screws 17 could also assume a feeding direction that deviates from the perpendicular.

The screws 17 which are distributed at regular intervals over the width of the cutter roller 3 are guided in bores 14, with the screws 17 being configured of a cylindrical pin 15 which acts on the blade 7, 8, and at the rearward end configured of a thread 16 which mates with a thread in bore 14. Each of the screws 17 and bores 14 associated with a mounting surface 12, 13 are arranged offset in the direction in which the cutter roller 3 extends with respect to the screws 17 and bores 14 on the opposite mounting surface 12, 13, since the pins 15 at the forward ends intersect. The change in the position of a cutting edge 5, 6 by means of the screws 17 is the result of the bending effect obtained by way of the feeding process on blades 7, 8, which integrally form the cutting edges 5, 6 due to their rectangular cross-sectional shape; the blade being provided with approximately parallel blade flanks with respect to the mounting surfaces 12, 13. For the purpose of preliminarily adjusting cutting edges 5, 6, the penetrating bores are configured as slots which are arranged to extend parallel to the adjustment movement.

A conduit 18 penetrating the cutter roller 3 parallel to the rotation axis is located behind mounting surfaces 12, 13. On the end face of the cutter roller this conduit is alternately connected via a rotating connection with a vacuum source, a compressed air source or the atmospheric environment by means of slots 19, 20 which resemble annular chambers and are shown by the dash-dot line in FIG. 1.

Figure 2:
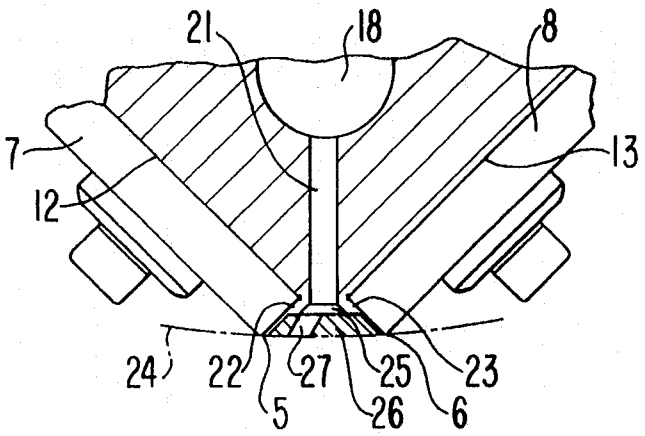
FIG. 2 is an enlarged sectional view of the cutting region in FIG. 1.

FIG. 2 shows conduit 18 and one of the connecting conduits 21 which communicate with it. These connecting conduits open at intervals along an outer line of cutter roller 3 into the intermediate space formed by cutting edges 5, 6, or more precisely, by the flanks of the two cutting edges.

At this location the cutter roller 3 is configured at its circumference by a narrow strip 22 which, together with the prismatic recesses 10, 11, forms a forward end stop 23 for cutting edges 5, 6. The strip 22 is set off each with respect to the cutting circle 24 of cutter roller 3, and the exit opening 25 of the connecting conduit 21 is widened, such that the latter communicates with the respective segments 27 of an air guide strip 26 which is fastened to strip 22. The air guide strip 26 is provided with obliquely arranged side surfaces which extend approximately parallel to the adjacent flanks of cutting edges 5, 6. These conduit segments 27 are angled with respect to connecting conduits 21 and are arranged laterally offset from the air guide strip so that narrow strips may be picked up by the vacuum.

The alternating connection of conduit 18 with the vacuum source or the compressed air source or the atmospheric environment, respectively, is accomplished by way of the stationary slots 19, 20 in the form of annular chambers provided on at least one end face of cutter roller 3, with the longer slot 19 being connected with the vacuum, and slot 20 with the pressure source. An exhaust hood 28 is arranged above cutter roller 3. An air stream acting in the direction of arrow B is produced in this suction cap and removes the strips from the spaces between cutting edges 5, 6.

On the cutter roller 3 shown in FIG. 1, two pairs of blades facing one another are provided on the circumference and the circumferential speed of the cutter roller 3 in relation to the speed of the paper panel is made adjustable.

It will be understood that the above description of the present invention is susceptible to various modifications, changes an adaptations, and the same are intended to be comprehended within the meaning and range of equivalents of the appended claims.

What is claimed is:

1. In a device for manufacturing uniform sheets from a material panel by removing strip-shaped segments extending transversely of a direction of movement of the material panel, said device comprising:

a rotating cutter roller which is driven to rotate through a cutting region in a direction corresponding to the direction of movement of the material panel, said cutter roller having a circumference including at least one pair of adjacent prismatic recesses, each recess presenting a mounting surface, the mounting surfaces being adjacent one another near Said circumference and extending into said roller away from each other such that each mounting surface is located on an opposite side of an approximately radial plane of said cutter roller and extends at an angle away from the radial plane, at least one adjustable pair of blades mounted on said cutter roller for interacting with a counter blade, each blade of each pair being mounted on a respective one of said mounting surfaces, and a feeding member located in the cutter roller behind each said blade extending approximately perpendicularly in relation to the mounting surface to which said blade is fastened for acting on said blade to adjust the position of said blade;

wherein said cutter roller has respective bores accommodating said feeding members, each said bore extending from the circumference of said cutter roller to one of said mounting surfaces, each said feeding member penetrating a respective one of said bores.

2. Device as defined in claim 1, wherein the angles at which each mounting surface extends from the radial plane are approximately equal.

3. Device as defined in claim 1, wherein each said blade has two flanks joined at an angle to form a cutting edge, and the angle of the two flanks has a bisector that extends in a first plane, said first plane intersecting said circumference and oriented approximately perpendicularly to a second plane which is tangent to said circumference at the intersection of said first plane and said circumference.

4. Device as defined in claims 1, wherein said feeding members each comprise a screw.

5. Device as defined in claim 4, wherein said bores are provided with a thread for engaging said screws.

6. In a device for manufacturing uniform sheets from a material panel by removing strip-shaped segments extending transversely of a direction of movement of the material panel, said device comprising:

a rotating cutter roller which is driven to rotate through a cutting region in a direction corresponding to the direction of movement of the material panel, said cutter roller having a circumference including at least one pair of adjacent prismatic recesses, each recess presenting a mounting surface, the mounting surfaces being adjacent one another near said circumference and extending into said roller away from each other such that each mounting surface is located on an opposite side of an approximately radial plane of said cutter roller and extends at an angle away from the radial plane, at least one adjustable pair of blades mounted on said cutter roller for interacting with a counter blade, each blade of each pair being mounted on a respective one of said mounting surfaces, and a feeding member located in the cutter roller behind each said blade extending approximately perpendicularly in relation to the mounting surface to which said blade is fastened for acting on said blade to adjust the position of said blade;

wherein said blades as well as said mounting surfaces are spaced apart from one another to form an intermediate space therebetween in a region at the circumference of said cutter roller and said cutter roller presents a narrow strip bordering on said intermediate space, said cutter roller including at least one connecting conduit which extends from an interior region of said cutter roller through said narrow strip and opens into said intermediate space for alternately connecting said intermediate space with a vacuum and a source of compressed air as said cutter roller is rotated.

7. Device as defined in claim 6, wherein said cutter roller includes an air guide strip in said intermediate space which is connected to said narrow strip, said air guide strip including conduit segments which are offset from a longitudinal axis of said connecting conduit and extend from the connecting conduit toward said circumference.

8. Device as defined in claim 7, wherein the conduit segments extend at an angle with respect to said connecting conduits.

9. Device as defined in claim 8, wherein said connecting conduit has a widened exit opening that communicates with said conduit segments.

10. Device as defined in claim 7, wherein said connecting conduit has a widened exit openings that communicates with said conduit segments.

* * * * *